US010041013B2

(12) United States Patent
Camero et al.

(10) Patent No.: US 10,041,013 B2
(45) Date of Patent: Aug. 7, 2018

(54) FISCHER-TROPSCH DERIVED FUEL COMPOSITIONS

(71) Applicant: SHELL OIL COMPANY, Houston, TX (US)

(72) Inventors: Mylin Camero, Hamburg (DE); Mary Ann Dahlstrom, Katy, TX (US); Paul Anthony Stevenson, Ince Chester (GB)

(73) Assignee: SHELL OIL COMPANY, Houston, TX (US)

( * ) Notice: Subject to any disclaimer, the term of this patent is extended or adjusted under 35 U.S.C. 154(b) by 125 days.

(21) Appl. No.: 14/653,389

(22) PCT Filed: Dec. 19, 2013

(86) PCT No.: PCT/EP2013/077342
§ 371 (c)(1),
(2) Date: Jun. 18, 2015

(87) PCT Pub. No.: WO2014/096169
PCT Pub. Date: Jun. 26, 2014

(65) Prior Publication Data

US 2015/0315507 A1 Nov. 5, 2015

(30) Foreign Application Priority Data

Dec. 20, 2012 (EP) ..... 12198659

(51) Int. Cl.
*C10L 1/00* (2006.01)
*C10L 1/16* (2006.01)
(Continued)

(52) U.S. Cl.
CPC ..... *C10L 1/1641* (2013.01); *C10L 1/18* (2013.01); *C10L 10/14* (2013.01); *C10L 10/16* (2013.01);
(Continued)

(58) Field of Classification Search
CPC ..... C10L 1/1641; C10L 1/18; C10L 2250/04; C10L 2270/026; C10L 1/1973; C10L 10/14; C10L 10/16; C10L 2200/0492
See application file for complete search history.

(56) References Cited

U.S. PATENT DOCUMENTS 4,208,190 A 6/1980 Malec
5,718,734 A * 2/1998 Davies ..... C08L 23/08 44/393
(Continued)

FOREIGN PATENT DOCUMENTS

EP 147873 7/1985
EP 160919 11/1985
(Continued)

OTHER PUBLICATIONS

5th Synfuels Worldwide Symposium, Washington DC, Nov. 1985 and 1989.

*Primary Examiner* — Cephia D Toomer

(57) ABSTRACT

A fuel composition comprising a Fischer-Tropsch derived middle distillate fuel and a middle distillate flow improver, the remainder being another fuel component or mixture of fuel components. The other fuel component is selected from petroleum derived middle distillate fuel, hydrogenated vegetable oil, fatty acid methyl esters, and other Fischer Tropsch products. The Fischer-Tropsch derived middle distillate fuel is more than 80% v/v of the total composition; the maximum weight content in the carbon number distribution of the n-paraffins in the Fischer-Tropsch derived middle distillate fuel is below C16 and the weight ratio of iso to normal paraffins in the Fischer-Tropsch derived middle distillate fuel is 3.5:1 or higher. The middle distillate flow improver is a substituted ethylene polymer.

9 Claims, 4 Drawing Sheets

(51) Int. Cl.

| | |
|---|---|
| ***C10L 1/18*** | (2006.01) |
| ***C10L 10/14*** | (2006.01) |
| ***C10L 10/16*** | (2006.01) |
| *C10L 1/197* | (2006.01) |

(52) U.S. Cl.
CPC ..... *C10L 1/1973* (2013.01); *C10L 2200/0492* (2013.01); *C10L 2250/04* (2013.01); *C10L 2270/026* (2013.01)

(56) References Cited

U.S. PATENT DOCUMENTS

| | | | | |
|---|---|---|---|---|
| 2004/0106690 | A1* | 6/2004 | DeHaan | C10L 1/08 518/726 |
| 2005/0138859 | A1* | 6/2005 | Jackson | C10L 1/143 44/389 |
| 2006/0196109 | A1* | 9/2006 | Morton | C10L 1/143 44/393 |
| 2008/0124607 | A1 | 5/2008 | Lin | |

FOREIGN PATENT DOCUMENTS

| | | |
|---|---|---|
| EP | 0583836 | 2/1994 |
| EP | 1690919 | 8/2006 |
| GB | 2077289 | 12/1981 |
| WO | 9607718 | 3/1996 |
| WO | 9907810 | 2/1999 |

* cited by examiner $^{1}$H NMR spectrum of dialysis residue of MDFI
(with major peaks clipped)

$^{13}C$ NMR spectrum of dialysis residue of MDFI

Carbon number distribution
C=16
Comparative Example 1
Comparative Example 3
GTL2
Comparative Example 2
GTL 1
N-paraffins, %wt
Carbon Number
0
1
2
3
4
5
6
6
11
16
21
26

Fig.4 CFPP dose response curve
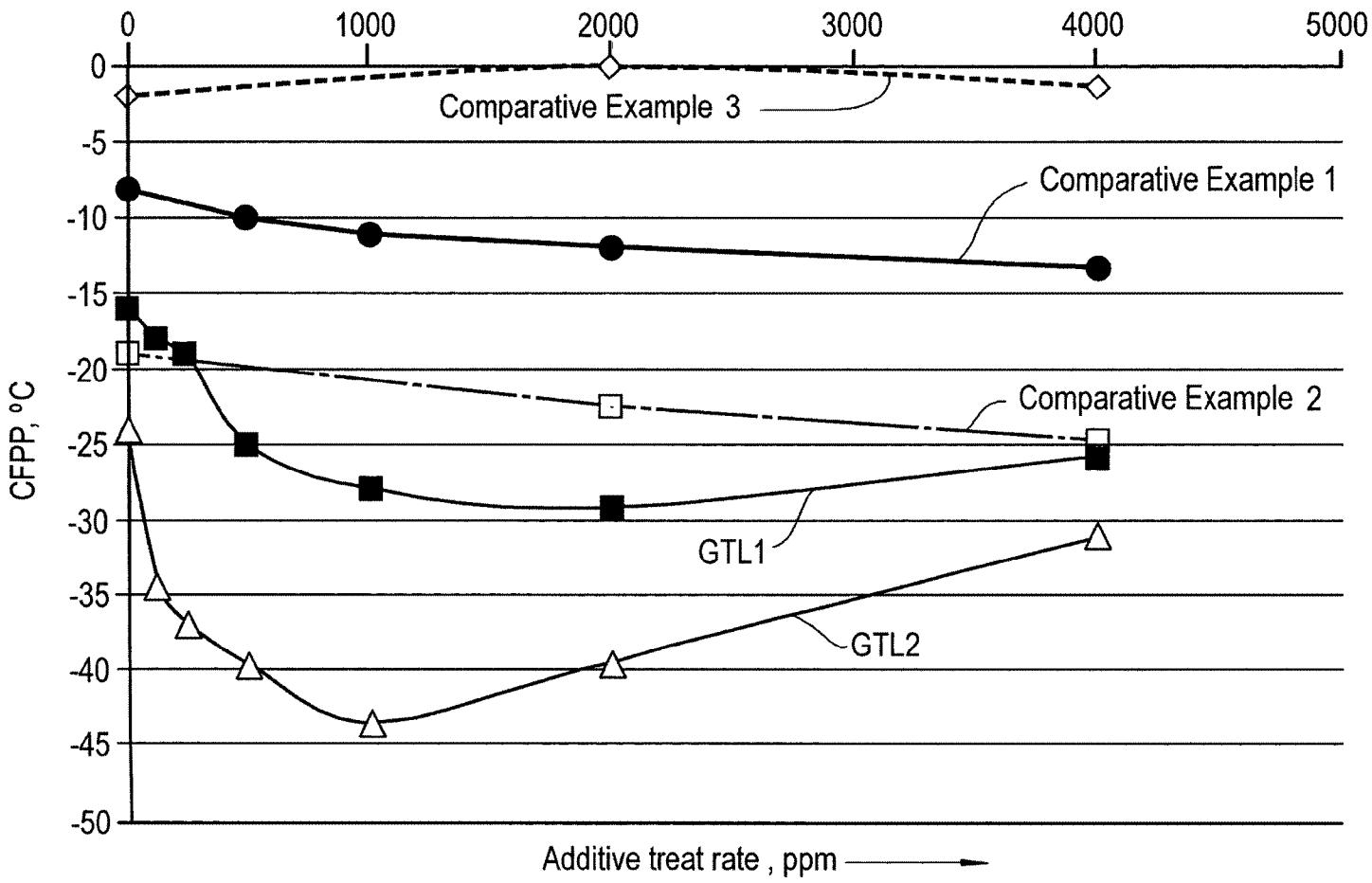

FISCHER-TROPSCH DERIVED FUEL COMPOSITIONS

PRIORITY CLAIM

The present application is the National Stage (§ 371) of International Application No. PCT/EP2013/077342, filed Dec. 19, 2013, which claims priority from European Patent Application 12198659.0, filed Dec. 20, 2012, incorporated herein by reference.

FIELD OF THE INVENTION

The present invention relates to Fischer-Tropsch derived fuel compositions, and to the use thereof as a fuel in cold climates.

BACKGROUND OF THE INVENTION

The present invention relates to the use of a cold flow improver in a "hard-to-treat" fuel.

Generally, distillate fuels are comprised of a mixture of hydrocarbons including normal (linear) and branched-chain (iso-) paraffins, olefins, aromatics and other polar and non-polar compounds, and cold flow behavior is a function of the relative proportion of these various hydrocarbon components. Normal paraffins typically have the lowest solubility and therefore tend to be the first solids to separate from the fuel as the temperature is decreased. At first, individual paraffin crystals will appear but as more crystals form they will ultimately create a gel-like network which inhibits flow. The compositional makeup of fuels can vary widely depending on the crude oil source and how deeply the refiner cuts into the crude oil. Refiners increasingly produce distillate fuels with amounts and types of hydrocarbon components which render the fuels unresponsive to additives which were before capable of imparting acceptable cold flow properties to the fuels (so-called "hard-to-treat" fuels). New groups of additives have been developed for treating such fuels. For middle distillate fuels the most important cold flow improver type is generally described as a middle distillate flow improver (MDFI). This additive type delivers an operability related response measured by CFPP (Cold Filter Plugging Point), which temperature is a parameter that is regulated in some major diesel fuel specifications (such as CEN EN590) or alternative laboratory filterability tests.

With the introduction of Fischer-Tropsch derived fuels (also called Gas-To-Liquid fuels or GTL fuels), which essentially contain paraffinic components, with a relatively high level of n-paraffin species, a new group of "hard-to-treat" fuels became available. Fischer-Tropsch derived fuels are the reaction products of the Fischer-Tropsch methane condensation processes, for example the process known as Shell Middle Distillate Synthesis (van der Burgt et al, "The Shell Middle Distillate Synthesis Process", paper delivered at the 5th Synfuels Worldwide Symposium, Washington D.C., November 1985; see also the November 1989 publication of the same title from Shell International Petroleum Company Ltd, London, UK). Although MDFI's are available for treating conventional hard-to-treat fuels, it was found that neat (essentially non-blended) Fischer-Tropsch derived (middle distillate) fuels have different properties than the conventional hard-to-treat middle distillate fuels and are generally not responsive to known MDFI's.

SUMMARY OF THE INVENTION

According to the present invention a unique composition has been found of an "essentially only" up to 100% Fischer-Tropsch derived middle distillate fuel that is fit-for-purpose in climates requiring low temperature flow to around −25° C. or lower (as measured in the CFPP test), e.g. for the northern European and Arctic climates.

Thus, an embodiment of the present invention is a fuel composition comprising a Fischer-Tropsch derived middle distillate fuel and a middle distillate flow improver, the remainder of the composition being another fuel component or mixture of fuel components, the fuel component being selected from a petroleum derived middle distillate fuel, hydrogenated vegetable oil, fatty acid methyl esters, and other Fischer Tropsch products such as light F-T base oil; wherein the amount of the Fischer-Tropsch derived middle distillate fuel is more than 80% v/v of the total composition; the maximum weight content in the carbon number distribution of the n-paraffins in the Fischer-Tropsch derived middle distillate fuel is below C16 and the weight ratio of iso to normal paraffins in the Fischer-Tropsch derived middle distillate fuel is 3.5:1 or higher; and wherein the middle distillate flow improver is a substituted ethylene polymer, being a single long alkyl chain substituted with acetate ester groups and 2-ethylhexanoate ester groups and further carrying some methyl branches, wherein the average ratio of acetate to 2-ethylhexanoate is 1:8, the mole percentage of acetate is 2% and 2-ethylhexanoate 16%, and the average number of methyl branches per 100 methylene groups (i.e. the degree of branching) is 4.9.

The compositions according to the present invention have exceptionally good cold flow properties at relatively low treat rates of the MDFI.

LEGEND TO THE DRAWINGS

FIG. 4 represents the results of CFPP tests of Fischer-Tropsch fuel compositions with the MDFI used in the present invention, in the form of a dose response curve.

DETAILED DESCRIPTION OF THE INVENTION

Figure 1:
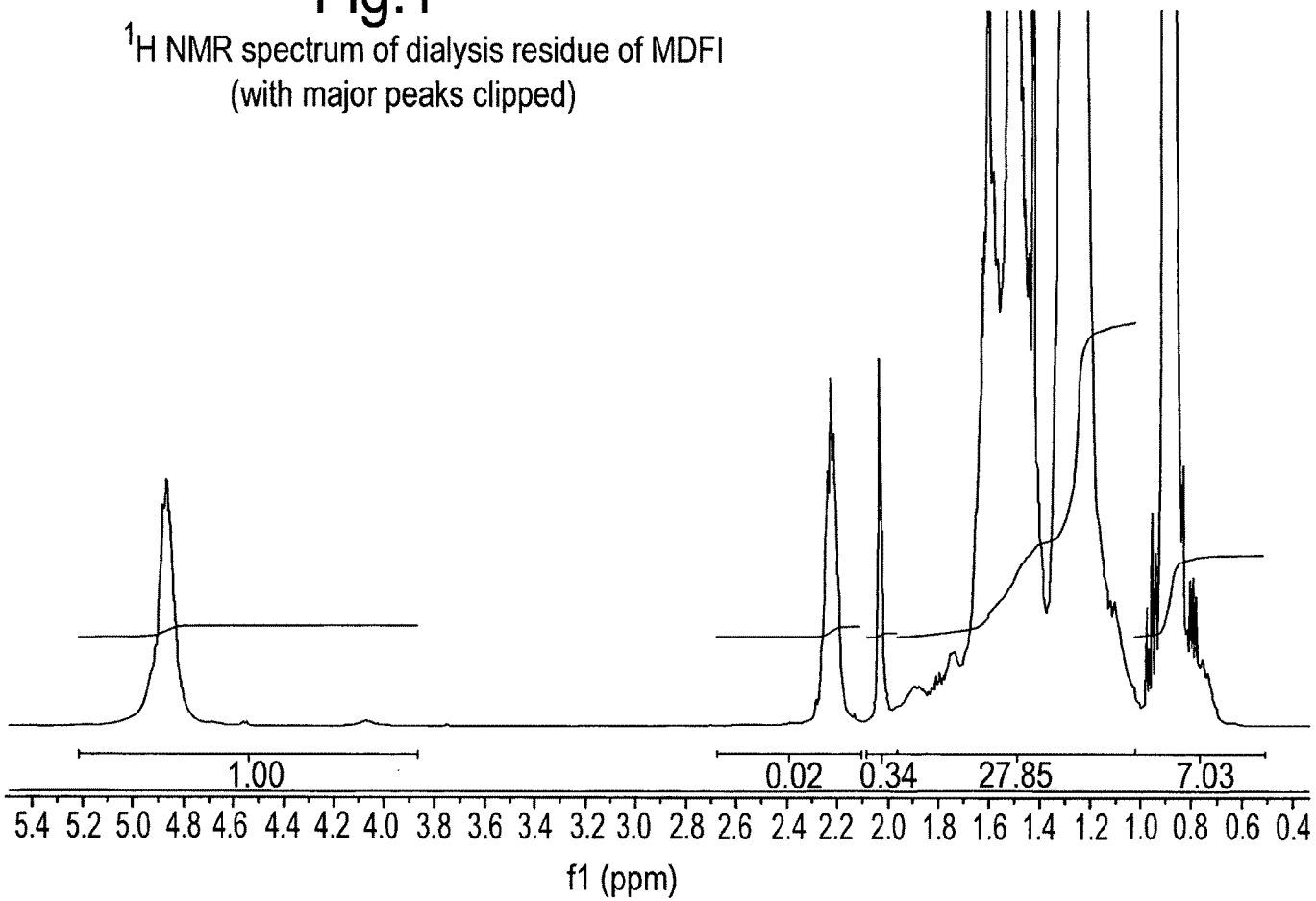
FIG. 1 represents a $^{1}H$ NMR spectrum of the MDFI used in the fuel compositions of the present invention.

In an embodiment of the invention, the CFPP is below −20° C., and preferably it is below −25° C.

The fuel composition of the present invention is particularly suitable for use as a diesel fuel, and in particular when used in climates requiring low temperature flow to around −25° C. or lower (as measured in the CFPP test). Accordingly, a further embodiment of the invention relates to the use of the fuel composition of the present invention as a fuel in a direct or indirect injection diesel engine, in particular wherein the engine runs at temperatures around −25° C. or lower.

The MDFI used in the fuel compositions of the present invention is a member of the class of oil-soluble ethylene terpolymers containing ethylene units and different vinyl ester units, such as disclosed in WO 96/07718. In this particular MDFI, the number average molecular weight ($M_n$) of the polymer, as measured by GPC, is approximately 12000. Further, the values for the ratio of acetate to 2-ethylhexanoate, the mole percentage of acetate and 2-ethylhexanoate and the degree of branching, as used herein in the definition of the MDFI, are averages over all the molecules in the polymer. In general, the side chains are distributed randomly over the polymer.

The properties of the MDFI used in the present invention, especially its high viscosity (488 cSt at 60° C.), result in recommended storage temperatures of 40-55° C., i.e. storage requires a heated tank. An embodiment of the present invention is a process for the preparation of the fuel compositions according to the invention comprising the step of combining warm MDFI injected into warm Fischer-Tropsch derived middle distillate fuel which ensures the MDFI is mixed and solubilised, wherein the MDFI is a single long alkyl chain substituted with acetate ester groups and 2-ethylhexanoate ester groups and further carrying some methyl branches, wherein the average ratio of acetate to 2-ethylhexanoate is 1:8, the mole percentage of acetate is 2% and 2-ethylhexanoate 16%, and the average number of methyl branches per 100 methylene groups is 4.9, and wherein the maximum weight content in the carbon number distribution of the n-paraffins in the Fischer-Tropsch derived middle distillate fuel is below C16 and the weight ratio of iso to normal paraffins in the Fischer-Tropsch derived middle distillate fuel is 3.5:1 or higher. In an alternative embodiment, the MDFI may be used in pre-diluted form, wherein a suitable solvent or the Fischer-Tropsch derived middle distillate fuel is used for diluting.

A further embodiment of the invention concerns the use of a MDFI which is a substituted ethylene polymer, being a single long alkyl chain substituted with acetate ester groups and 2-ethylhexanoate ester groups and further carrying some methyl branches, wherein the average ratio of acetate to 2-ethylhexanoate is 1:8, and the mole percentage of acetate is 2% and 2-ethylhexanoate 16%, and the average number of methyl branches per 100 methylene groups is 4.9, for the purpose of improving the cold flow properties of a fuel composition comprising an amount of a Fischer-Tropsch derived middle distillate fuel of more than 80% v/v of the total composition, wherein the maximum weight content in the carbon number distribution of the n-paraffins in the Fischer-Tropsch derived middle distillate fuel is below C16 and the weight ratio of iso to normal paraffins in the Fischer-Tropsch derived middle distillate fuel is 3.5:1 or higher, and wherein the cold flow properties are improved to a CFFP of around −25° C. or lower.

Suitably, the treat rate of the MDFI in the fuel composition of the present invention is 125-5000 mg/kg, preferably 250-4000 mg/kg, more preferred 500-3000 mg/kg, and especially 750-2000 mg/kg.

The fuel composition according to the present invention preferably comprise an amount of the Fischer-Tropsch derived middle distillate fuel of at least 90%, more preferred at least 95%, especially at least 98% v/v, in particular at least 99% v/v of the total composition and most preferred is a fuel composition wherein the Fischer-Tropsch derived middle distillate fuel is the only fuel component in the fuel composition.

The Fischer-Tropsch derived middle distillate fuel will typically satisfy the requirements of a fuel specification, for example CEN TS 15940 (Automotive Fuels—Paraffinic Diesel Fuel from Synthesis or Hydrotreatment—Requirements and Test Methods).

For diesel fuel applications, the Fischer-Tropsch derived middle distillate fuel should be suitable for use as a diesel fuel. Its components (or the majority, for instance 95% v/v or greater, thereof) should therefore have boiling points within the typical diesel fuel ("gas oil") range, i.e. from about 150 to 400° C. or from 170 to 370° C. It will suitably have a 90% v/v distillation temperature of from 300 to 370° C.

By "Fischer-Tropsch derived" is meant that the fuel is, or derives from, a synthesis product of a Fischer-Tropsch condensation process. The Fischer-Tropsch reaction converts carbon monoxide and hydrogen into longer chain, usually paraffinic, hydrocarbons: $n(CO+2H_2)=(—CH_2—)_n+nH_2O$+heat, in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane.

A middle distillate fuel product may be obtained directly from the Fischer-Tropsch reaction, or indirectly for instance by fractionation of a Fischer-Tropsch synthesis product or from a hydrotreated Fischer-Tropsch synthesis product. Hydrotreatment can involve hydrocracking to adjust the boiling range (see, e. g. GB2077289 and EP0147873) and/or hydroisomerisation which can improve cold flow properties by increasing the proportion of branched paraffins. EP0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired middle distillate fuel fraction(s) may subsequently be isolated for instance by distillation.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP0583836.

An example of a Fischer-Tropsch based process is the SMDS (Shell Middle Distillate Synthesis) described in "The Shell Middle Distillate Synthesis Process", van der Burgt et al (vide supra). This process produces middle distillate range products by conversion of a natural gas (primarily methane) derived synthesis gas into a heavy long-chain hydrocarbon (paraffin) wax which can then be hydroconverted and fractionated to produce liquid transport fuels such as the gas oils useable in diesel fuel compositions. Versions of the SMDS process, utilising fixed-bed reactors for the catalytic conversion step, are currently in use in Bintulu, Malaysia, and in Pearl GTL, Ras Laffan, Qatar. Middle distillate fuels prepared by the SMDS process are commercially available for instance from the Royal Dutch/Shell Group of Companies. Such Fischer-Tropsch middle distillate fuels are described in Technical Specification CEN TS 15940.

Suitably, in accordance with the present invention, the Fischer-Tropsch derived middle distillate fuel will consist of at least 95% w/w, more preferably at least 98% w/w, and most preferably up to 100% w/w of paraffinic components, preferably iso- and normal paraffins. Some cyclic paraffins may also be present. According to the present invention the weight ratio of iso-paraffins to normal paraffins is at least 3.5, in particular at least 4.0, and preferably from 4.0 to 7.5. In contrast, it was found that Fischer-Tropsch derived middle distillate fuel samples wherein the weight ratio of iso-paraffins to normal paraffins is lower than 3.5, e.g.

between 1 and 2, do not show similar favourable effects in their CFFP when treated with the MDFI used in the fuel compositions of the present invention.

According to the invention, the maximum weight content in the carbon number distribution of the n-paraffins in the Fischer-Tropsch derived middle distillate fuel is below C16. This means, that in a plot in which the n-paraffin carbon number of a sample of the middle distillate fuel is set out on the x-axis and the weight percentage in the sample of each carbon number in the sample on the y-axis of the graph, the highest peak in the weight percentage is found below C16. In contrast, it was found that Fischer-Tropsch derived middle distillate fuel samples with a peak higher than C16 do not show similar favourable effects in their CFFP when treated with the MDFI used in the fuel compositions of the present invention.

By virtue of the Fischer-Tropsch process, a Fischer-Tropsch derived middle distillate fuel has essentially no, or undetectable levels of, sulfur and nitrogen. Compounds containing these heteroatoms tend to act as poisons for Fischer-Tropsch catalysts and are therefore removed from the synthesis gas feed. Further, the process as usually operated produces no or virtually no aromatic components.

The aromatics content of a Fischer-Tropsch middle distillate fuel, as determined for instance by ASTM D4629, will typically be below 1% w/w, preferably below 0.5% w/w and more preferably below 0.1% w/w.

The Fischer-Tropsch derived middle distillate fuel used in the present invention will typically have a density from 0.76 to 0.79 g/cm$^3$ at 15° C.; a cetane number (ASTM D613) greater than 70, suitably from 74 to 85; a kinematic viscosity (ASTM D445) from 2 to 4.5, preferably 2.5 to 4.0, more preferably from 2.9 to 3.7, mm$^2$/s at 40° C.; and a sulfur content (ASTM D2622) of 5 ppmw (parts per million by weight) or less, preferably of 2 ppmw or less.

Preferably the Fischer-Tropsch derived middle distillate fuel according to the present invention is a product prepared by a Fischer-Tropsch methane condensation reaction using a hydrogen/carbon monoxide ratio of less than 2.5, preferably less than 1.75, more preferably from 0.4 to 1.5. Further, preferably the Fischer-Tropsch derived middle distillate fuel according to the present invention is a product prepared by the SMDS process, utilising fixed-bed multi-tubular reactors and a promoted cobalt catalyst. Suitably it will have been obtained from a hydrocracked Fischer-Tropsch synthesis product, or more preferably a product from a two-stage hydroconversion process such as that described in EP0583836.

Generally speaking, in the context of the present invention the fuel composition may be additivated with further additives. Unless otherwise stated, the (active matter) concentration of each such additive in a fuel composition is preferably up to 10000 ppmw, more preferably in the range from 5 to 1000 ppmw, advantageously from 75 to 300 ppmw, such as from 95 to 150 ppmw. Such additives may be added at various stages during the production of a fuel composition; those added to a base fuel at the refinery for example might be selected from anti-static agents, pipeline drag reducers, flow improvers (e.g., ethylene/vinyl acetate copolymers or acrylate/maleic anhydride copolymers), lubricity enhancers, anti-oxidants and wax anti-settling agents.

The fuel composition may for instance include a detergent, by which is meant an agent (suitably a surfactant) which can act to remove, and/or to prevent the build up of, combustion related deposits within an engine, in particular in the fuel injection system such as in the injector nozzles. Such materials are sometimes referred to as dispersant additives. Where the fuel composition includes a detergent, preferred concentrations are in the range 20 to 500 ppmw active matter detergent based on the overall fuel composition, more preferably 40 to 500 ppmw, most preferably 40 to 300 ppmw or 100 to 300 ppmw or 150 to 300 ppmw. Detergent-containing diesel fuel additives are known and commercially available. Examples of suitable detergent additives include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Particularly preferred are polyolefin substituted succinimides such as polyisobutylene succinimides.

Other components which may be incorporated as fuel additives, for instance in combination with a detergent, include lubricity enhancers; dehazers, e.g. alkoxylated phenol formaldehyde polymers; anti-foaming agents (e.g. commercially available polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; static dissipator additives; and mixtures thereof.

It is preferred that the additive contain an anti-foaming agent, more preferably in combination with an anti-rust agent and/or a corrosion inhibitor and/or a lubricity additive.

It is particularly preferred that a lubricity enhancer be included in the fuel composition, especially when it has a low (e.g. 500 ppmw or less) sulfur content. The lubricity enhancer is conveniently present at a concentration from 50 to 1000 ppmw, preferably from 100 to 1000 ppmw, based on the overall fuel composition.

The (active matter) concentration of any dehazer in the fuel composition will preferably be in the range from 1 to 20 ppmw, more preferably from 1 to 15 ppmw, still more preferably from 1 to 10 ppmw and advantageously from 1 to 5 ppmw. The (active matter) concentration of any ignition improver present will preferably be 600 ppmw or less, more preferably 500 ppmw or less, conveniently from 300 to 500 ppmw.

The present invention may in particular be applicable where the fuel composition is used or intended to be used in a direct injection diesel engine, for example of the rotary pump, in-line pump, unit pump, electronic unit injector or common rail type, or in an indirect injection diesel engine. The fuel composition may be suitable for use in heavy- and/or light-duty diesel engines, emissions benefits often being more marked in heavy-duty engines.

The invention is illustrated by the following non-limiting examples.

Example 1

The MDFI used in the fuel compositions of the present invention is a member of the class of oil-soluble ethylene terpolymers containing ethylene units and different vinyl ester units, such as disclosed in WO 96/07718. The MDFI was commercially obtained from Infineum and analysed.

A sample of the MDFI additive was separated by the process of dialysis, which will be familiar to those skilled in the art of fuel and lubricant analysis. In brief, a solution of the sample was contained in a rubber membrane with a suitable dialysing solvent, such as petroleum spirit, continually circulating around the outside of the membrane. The sample was dialysed for a set period of time to allow the low molecular weight material to diffuse through the membrane. The solvent was then removed from each fraction to produce a dialysis residue (the higher molecular weight additives) and the dialysate (the oil and lower molecular weight additives).

Gel permeation chromatography (GPC) was performed using a Polymer Laboratories GPC50 Plus instrument and 5 μm mini-mix D columns calibrated using polystyrene standards in the range 580 to 377,400 Daltons.

$^{1}H$ and $^{13}C$ NMR spectra were obtained using a Varian 500 MHz.

Dialysis Results

The result of separation of the MDFI using dialysis is shown below.

| Dialysate (% m/m) | Dialysis Residue (% m/m) | Recovery (% m/m) |
|---|---|---|
| 37.2 | 62.8 | 100.0 |

Results Gel Permeation Chromatography

A portion of the dialysis residue was analysed using GPC to determine the molecular weight distribution of its consituent polymer(s). The molecular weight data extracted from the chromatogram are given in the table below.

| Type of average molecular weight | | | | Polydispersity |
|---|---|---|---|---|
| $M_p$ | $M_n$ | $M_w$ | $M_z$ | index* |
| 14119 | 12076 | 21398 | 37501 | 1.77 |

*Polydispersity index is given by $M_w/M_n$

NMR Spectroscopy

The $^{1}H$ NMR spectrum obtained for the dialysis residue of the MDFI is shown in FIG. 1.

The area under each of the peaks B (2.2 ppm), C (2.0 ppm), D (1-7-1.0 ppm) and E (1.9 ppm) in FIG. 1 was taken.

Then the degree of branching of the polymer was calculated as:

$$(E-6B/3)\times(2/D-6B)\times 100$$

(in accordance with the calculation of degree of branching of the polymer as defined by reference to peak integrals shown in an NMR spectrum in EP1007606)

Evaluating this quantity for FIG. 1 gives a degree of branching for this sample of 4.91.

A comparison of all the integrated signal intensities in FIG. 1 is given in the following table:

| Normalised $^{1}H$ NMR integral | | | | |
|---|---|---|---|---|
| A* | B | C | D | E |
| 2.7 | 2.5 | 0.9 | 75.0 | 18.9 |

*4.9 ppm

Figure 2:
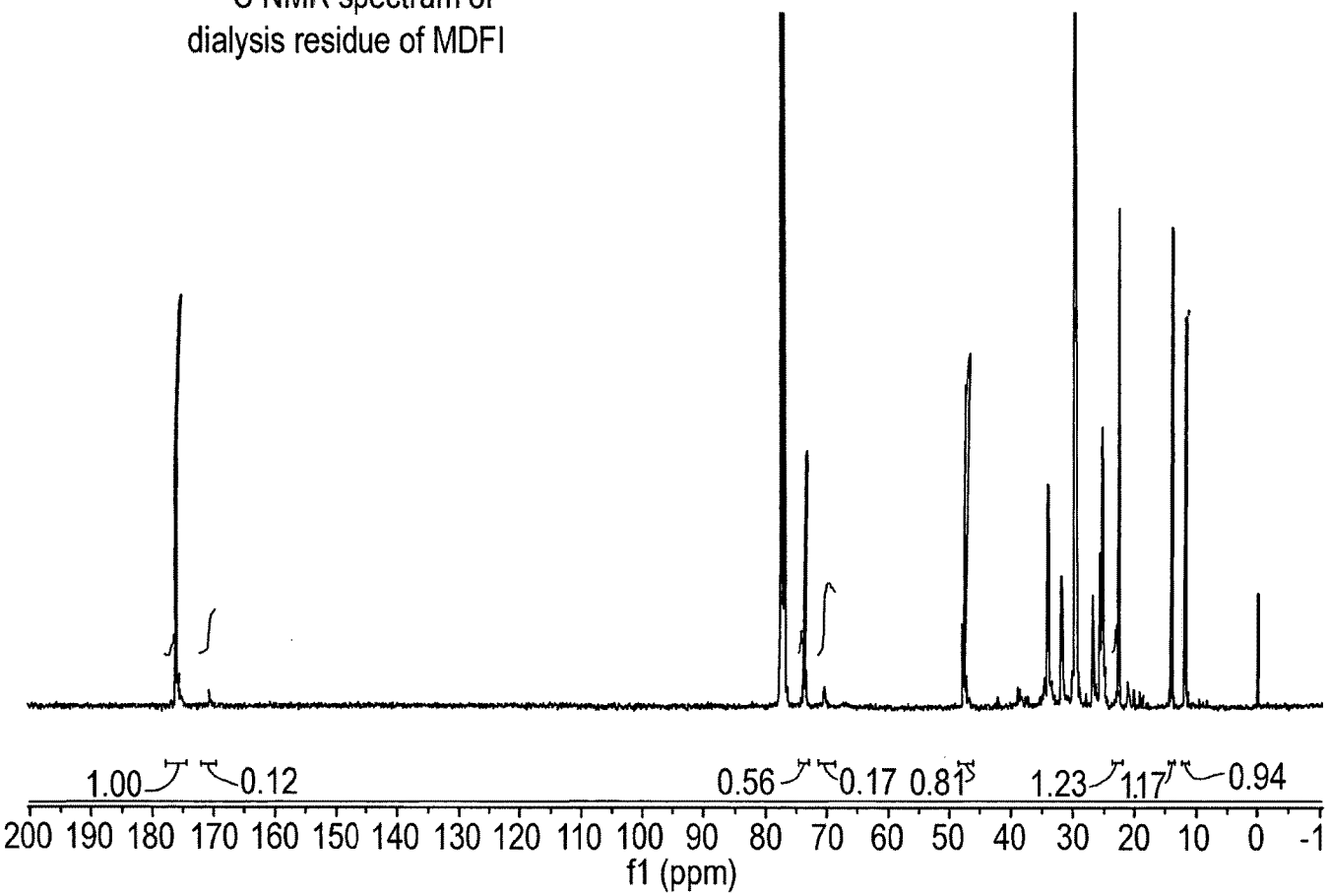
FIG. 2 represents a $^{13}C$ NMR spectrum of the MDFI used in the fuel compositions of the present invention.

The $^{13}C$ NMR spectrum of the MDFI is shown in FIG. 2. The spectrum is consistent with the sample being a terpolymer of ethylene, vinyl acetate and vinyl 2-ethylhexanoate. Clear evidence for the presence of both types of vinyl monomer appears in the carbonyl region of the spectrum: the signals from 2-ethylhexanoate carbonyls are around 176 ppm and are resolved from the acetate peaks at about 171 ppm. Integration of these signals indicates that the molar ratio of the monomers is 0.12 acetate units to every 2-ethylhexanoate unit. This ratio can also be calculated from the $^{1}H$ NMR (as C/3B) and the same value is obtained.

Fischer-Tropsch Composition Examples

General— for all Fischer-Tropsch (GTL) fuel samples: The fuels were characterized using standard methods:

| | |
|---|---|
| IP 123 | Distillation |
| D5773/IP219 | Cloud point |
| IP 365 | Density |
| EN116 | Cold Filter Plugging Point Test |
| IP 71 | Viscosity |
| ISO 20846/ISO 20884 | Sulfur |

Paraffin content and distribution were determined via GC. To develop response curves for each GTL Fuel, samples of each fuel were additivated with treat rates of between 0 to 4000 mg/kg of the MDFI described in Example 1. Each fuel sample was run via EN116 (in duplicate or triplicate). CFPP results for each sample were averaged to arrive at its Cold Filter Plugging Point. The Cold Filter Plugging Point is an estimate of the lowest temperature at which a fuel will give trouble-free flow in certain fuel systems.

Example 2

Figure 3:
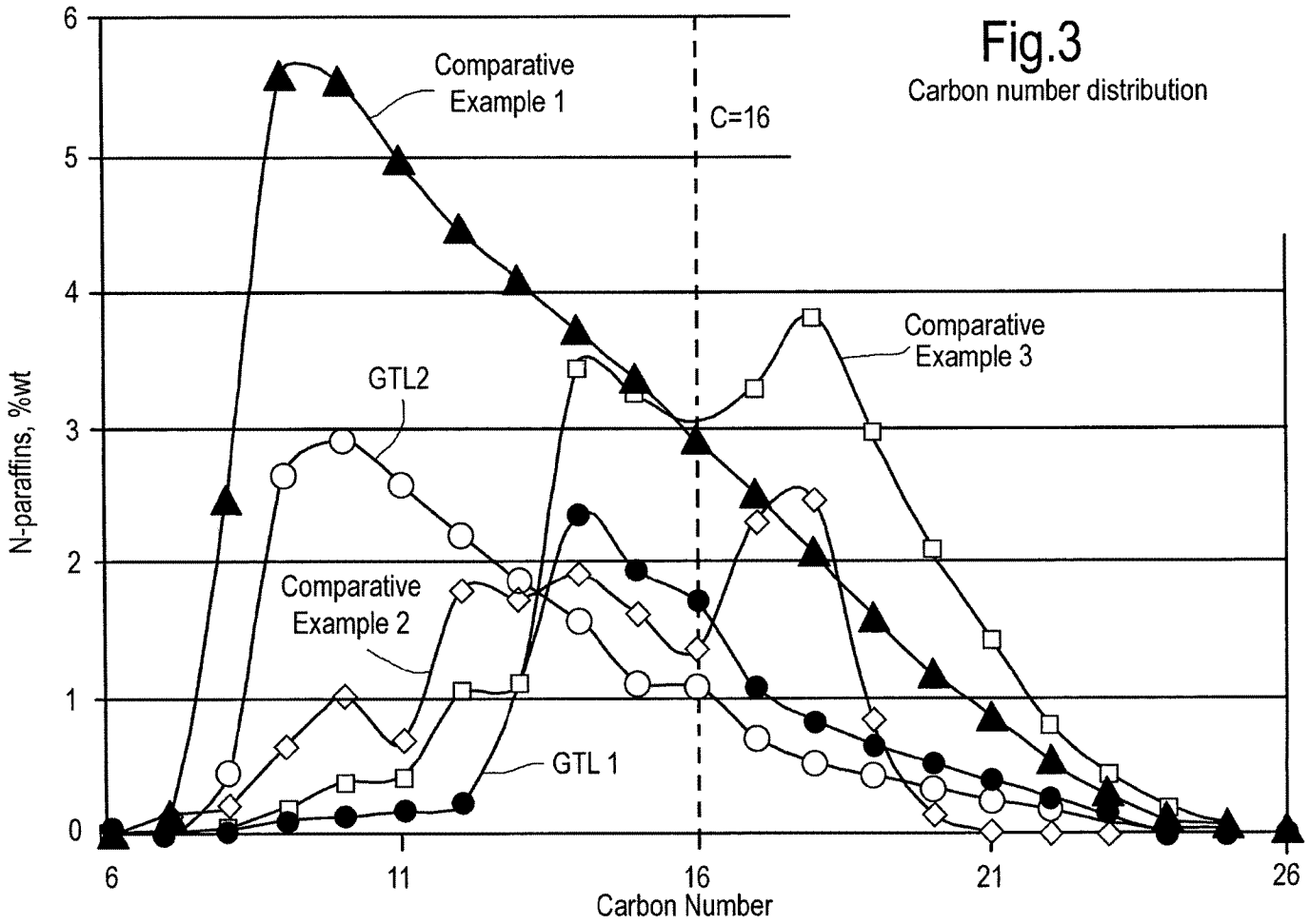
FIG. 3 represents the carbon number distribution of the normal paraffins (unbranched alkanes) in the Fischer-Tropsch fuels tested.

The MDFI described in Example 1 was mixed with a Fischer-Tropsch-derived gasoil (GTL1) to obtain solutions covering a range of concentrations between 0-4000 mg/kg (parts per million by weight, or ppmw). Properties of GTL 1 are listed in Table 1. The carbon number distribution of the normal paraffins (unbranched alkanes) in GTL 1 is shown in FIG. 3. Solutions were prepared by weighing an appropriate amount of the MDFI into an empty, tared container on an analytical balance, then adding GTL until the target weight was obtained. The containers were sealed with a cap and shaken thoroughly to ensure adequate mixing of the contents. The resulting solutions, which were clear in appearance at room temperature (21° C.), were tested according to the automated procedure specified by the European Committee for Standardisation (CEN) in EN 116: "Diesel and Domestic Heating Fuels-Determination of Cold Filter Plugging Point". The results of the CFPP tests are shown in the form of a dose response curve in FIG. 4.

TABLE 1

| Properties of untreated gasoil | | | | | | | |
|---|---|---|---|---|---|---|---|
| Test | Method | Units | GTL 1 | GTL 2 | Comparative Example 1 | Comparative Example 2 | Comparative Example 3 |
| Density @ 15° C. | IP 365 | $kg/m^3$ | 787.1 | 773.0 | 769.9 | 777 | 783.8 |
| Viscosity, 40° C. | IP 71 | $mm^2/s$ | 3.7 | 2.2 | 2.2 | 2.5 | 3.4 |
| Sulfur | ISO 20846/ISO 20884 | mg/kg | | | <3.0 | <5.0 | <3 |
| Cloud Point. | ASTM D5773/IP219 | ° C. | −13 | −20 | −8 | −14 | 2 |
| CFPP | EN116 | ° C. | −16 | −22 | −8 | −19 | −2 |
| Isoparaffin:normal paraffin weight ratio | GC | — | 7.5 | 4.1 | 1.1 | 4.9 | 2.6 |
| Distillation: 95% (v/v) recovered | IP 123 | ° C. | 341.3 | 336.6 | 340.6 | 312.6 | 346.1 |
| Carbon number at max % wt normal paraffins | See FIG. 3 | — | 14 | 10 | 9 | 18 | 18 |
| Slope[1] | See characteristic (i) EP1690919 | — | −0.126 | −0.083 | −0.475 | −1.628 | −0.994 |
| n-paraffin ratio C >22[2] | See characteristic (ii) EP1690919 | — | 0.043 | 0.040 | 0.069 | 0 | 0.064 |

[1]the slope of the "mass % n-alkane" vs "carbon number" curve between C18 and C26

[2]the ratio of the mass of n-alkanes of C >22 to the mass of n-alkanes from C18 to C21

Example 3

The MDFI described in Example 1 was used to prepare solutions in a second Fischer-Tropsch-derived gasoil (GTL 2) according to the same procedure outlined in Example 2. Properties of GTL 2 are listed in Table 1. The carbon number distribution of the normal paraffins (unbranched alkanes) in GTL 2 is shown in FIG. 3. Results of CFPP tests on the samples for Example 3 are shown in FIG. 4.

Comparative Example 1

The MDFI described in Example 1 was used to prepare solutions in another Fischer-Tropsch-derived gasoil (Comparative Example 1) at concentrations between 0 and 4000 mg/kg (ppmw) using the same procedure outlined in Example 2. Properties of Comparative Example 1 are listed in Table 1. The carbon number distribution of the normal paraffins (unbranched alkanes) in Comparative Example 1 is shown in FIG. 3. Results of CFPP tests on the samples for Comparative Example 1 are shown in FIG. 4.

Comparative Example 2

The MDFI described in Example 1 was used to prepare solutions in another Fischer-Tropsch-derived gasoil (Comparative Example 2) at concentrations of 0, 2000 and 4000 mg/kg (ppmw) using the same procedure outlined in Example 2. Properties of Comparative Example 2 are listed in Table 1. The carbon number distribution of the normal paraffins (unbranched alkanes) in Comparative Example 1 is shown in FIG. 3. Results of CFPP tests on the samples for Comparative Example 2 are shown in FIG. 4.

Comparative Example 3

The MDFI described in Example 1 was used to prepare solutions in another Fischer-Tropsch-derived gasoil (Comparative Example 3) at concentrations between 0 and 4000 mg/kg (ppmw) using the same procedure outlined in Example 2. Properties of Comparative Example 3 are listed in Table 1. The carbon number distribution of the normal paraffins (unbranched alkanes) in Comparative Example 3 is shown in FIG. 3. Results of CFPP tests on the samples for Comparative Example 3 are shown in FIG. 4.

CONCLUSIONS

Referring to the results in FIG. 2, it was found that for the MDFI to be effective in reducing the CFPP of Fischer-Tropsch derived paraffinic diesel fuels, the fuel needs to satisfy both of the following conditions:

(i) An Isoparaffins:normal paraffins weight ratio of >3.5 and (ii) The carbon chain length distribution curve (illustrated in FIG. 3) for normal paraffins must show a maximum weight fraction at a carbon number less than 16.

That which is claimed is:

1. A fuel composition comprising a Fischer-Tropsch derived middle distillate fuel and a middle distillate flow improver, the remainder of the composition being another fuel component or mixture of fuel components, the other fuel component being selected from a petroleum derived middle distillate fuel, hydrogenated vegetable oil, fatty acid methyl esters, and other Fischer Tropsch products such as light F-T base oil;

wherein the amount of the Fischer-Tropsch derived middle distillate fuel is at least 90% v/v of the total composition;

the maximum weight content in the carbon number distribution of the n-paraffins in the Fischer-Tropsch derived middle distillate fuel is below C16 and the weight ratio of iso to normal paraffins in the Fischer-Tropsch derived middle distillate fuel is 3.5:1 or higher; and wherein the middle distillate flow improver is a substituted ethylene polymer, being a single long alkyl chain substituted with acetate ester groups and 2-ethylhexanoate ester groups and further carrying some methyl branches, wherein the average ratio of acetate to 2-ethylhexanoate is 1:8, the mole percentage of acetate is 2% and 2-ethylhexanoate 16%, and the average number of methyl branches per 100 methylene groups is 4.9, and wherein the middle distillate flow improver is present in the composition at a treat rate of 500-4000 mg/kg, and wherein the CFPP of the fuel composition is below −25° C.

2. The fuel composition of any claim 1, wherein the Fischer-Tropsch derived middle distillate fuel consists of at least 95% w/w of paraffinic components.

3. The fuel composition of claim 1 wherein the weight ratio of iso to normal paraffins in the Fischer-Tropsch derived middle distillate fuel is at least 4.0.

4. The fuel composition of claim 1, wherein the middle distillate flow improver is present in the composition at a treat rate of 500-3000 mg/kg.

5. The fuel composition of claim 1, wherein the middle distillate flow improver is present in the composition at a treat rate of 750-2000 mg/kg.

6. The fuel composition of claim 1, wherein the amount of the Fischer-Tropsch derived middle distillate fuel is at least 95% v/v of the total composition.

7. The fuel composition of claim 1, wherein the amount of the Fischer-Tropsch derived middle distillate fuel is at least 98% v/v of the total composition.

8. The fuel composition of claim 1, wherein the amount of the Fischer-Tropsch derived middle distillate fuel is at least 99% v/v of the total composition.

9. The fuel composition of claim 1, wherein the Fischer-Tropsch derived middle distillate fuel is the only fuel component in the fuel composition.

* * * * *